United States Patent [19]

Pezzini et al.

[11] 4,211,252

[45] Jul. 8, 1980

[54] HYDRAULIC COUPLER

[75] Inventors: Mario Pezzini, Baton Rouge; Elmer P. Myers, Greenwell Springs, both of La.

[73] Assignee: The Yaun-Williams Bucket Co., Baton Rouge, La.

[21] Appl. No.: 874,102

[22] Filed: Feb. 1, 1978

[51] Int. Cl.[2] ..... B25B 1/00; B66C 1/00

[52] U.S. Cl. ..... 137/580; 294/86 R

[58] Field of Search ..... 137/580; 285/136; 294/86 R, 88; 214/138 R, 138 F, 138.6; 37/184, 186

[56] References Cited

U.S. PATENT DOCUMENTS

| | | | |
|---|---|---|---|
| 3,413,029 | 11/1968 | Donovan | 294/88 X |
| 3,908,695 | 9/1975 | Dunbar | 137/580 |
| 3,914,886 | 10/1975 | Berg et al. | 285/136 X |
| 3,966,249 | 6/1976 | Lindquist | 285/136 X |

*Primary Examiner*—William R. Cline

*Attorney, Agent, or Firm*—Watts, Hoffmann, Fisher & Heinke Co.

[57] ABSTRACT

A coupler for connecting a hydraulically actuated material handling implement to an overhead support comprising a first assembly for connection to an overhead support, a second assembly for connection to a hydraulically actuated material handling implement and having a cylindrical part extending into and rotatably connected to the first assembly, a manifold part adjustably connected to the first assembly and extending into an aperture in the second assembly and having a plurality of axially spaced circumferential grooves in its outer surface, a plurality of apertures in the manifold part having their one ends adapted for the connection of flexible hoses and their other ends communicating with different ones of the grooves therein and a plurality of apertures in the second assembly having their one ends adapted for the connection of flexible hoses and their other ends communicating with different ones of the grooves in the manifold part of the first assembly.

6 Claims, 5 Drawing Figures

HYDRAULIC COUPLER

FIELD OF THE INVENTION

The invention relates to the transmission of hydraulic fluid between two relatively rotatable members without the use of flexible hoses and more specifically to a coupler for connecting a hydraulically actuated material handling implement, for example, a grapple, for rotation through three hundred and sixty degrees (360°) to a movable overhead support, for example, the boom of a crane.

DESCRIPTION OF THE PRIOR ART

Devices for connecting hydraulically actuated material handling implements to an overhead support for rotation through three hundred and sixty degrees (360°) without the use of flexible hoses are known but such devices are generally large, heavy and bulky and/or fail in service. None are satisfactory particularly for heavy duty use, at least in part, because some of the fluid transmission parts thereof are exposed and therefore subject to being damaged by external objects. Typical, such prior art devices as disclosed in U.S. Pat. Nos. to Donovan 3,413,029 and Dunbar 3,908,695.

SUMMARY OF THE PRESENT INVENTION

The present invention provides a novel and improved coupler for connecting a hydraulically operated implement to a support for rotation through three hundred and sixty degrees (360°) without the use of flexible hoses between the relatively rotatable parts of the coupler. The coupler is compact and rugged in construction and the relatively rotatable fluid conduit parts are not subjected to side loading and are enclosed by the coupler housing and therefore not subject to injury by contact with external members.

The invention provides a coupler as mentioned above which includes mechanism for producing controlled rotation between the relatively rotatable parts of the coupler and releasable securing the same in any selected relative position.

The invention resides in certain constructions and arrangements of parts and further objects and advantages of the invention will be apparent and/or will be referred to in the following description of the preferred embodiment of the invention.

DESCRIPTION OF THE PREFERRED EMBODIMENT

Figure 1:
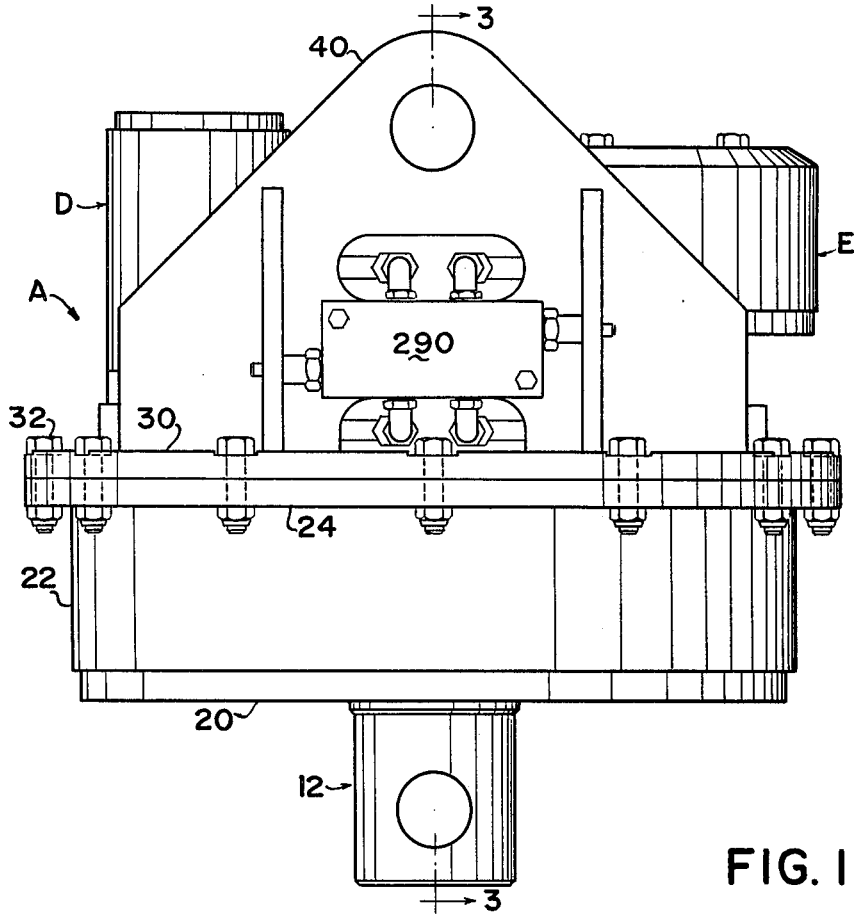
FIG. 1 is an elevational view of a coupler embodying the present invention for connecting a hydraulically actuated material handling implement to an overhead support.
Figure 2:
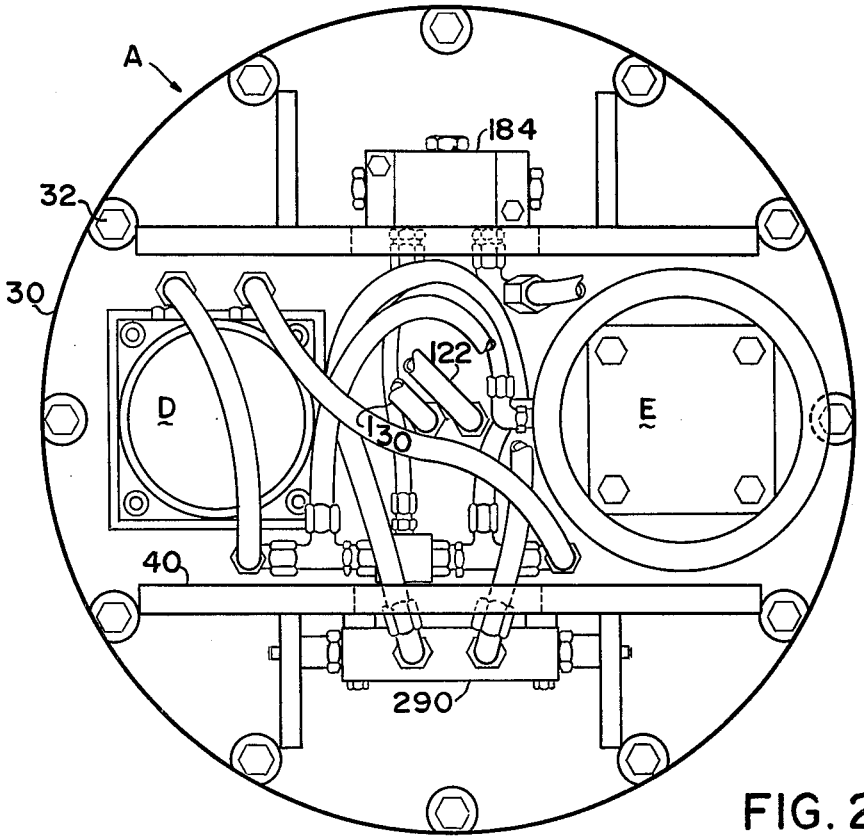
FIG. 2 is a plan view of the coupler.

The coupler of the present invention is especially useful for connecting an overhead supported rotatable, hydraulically operated implement to a movable overhead support and the preferred embodiment herein depicted and described is adapted for use with relatively heavy rotatable, hydraulically actuated material handling implements, such as, material grapples, clamshell buckets, and the like, suspended from a movable overhead support, such as the boom of a crane. The particular constructions of the material handling grab, for example a grapple, and the supporting device, for example a crane, are conventional and only parts of typical adapters for connecting the coupler to such devices are shown in phantom lines in the drawing.

The depicted coupler, designated generally by the reference character A is designed for suspending a rotatable material grab, not shown, which may be a grapple, or the like, from an overhead support, not shown, which may be the boom of the crane. The coupler A comprises two relatively rotatable assemblies 10,12 mechanically connected to one another for rotation through three hundred and sixty degrees (360°) by tapered roller bearings 14,16. Assembly 10 is adapted to be connected to a movable overhead support by an upper adapter B and assembly 12 to a grab by a lower adapter C. The assembly 10 comprises a gear case or housing comprising an annular plate-like part 20 having an annular or collar-like part 22 welded to its peripheral edge. The part 22 has an exterior ring-like part 24 welded to its upper end forming an annular flange to which a second annular plate-like part 30 is detachably secured by bolts 32. The adapter C for connecting the coupler A to a movable overhead support is pivotally connected to the assembly 10 by a bolt 34 extending therethrough and two spaced vertical plate-like parts 40,42 welded to the outer side of the part 30.

The assembly 12 comprises a cylindrical member or shaft 50 extending through a central aperture in the part 20 of assembly 10 to approximately the inner side of the part 30 from which it is spaced slightly so as to permit free relative rotation between the parts. The lower adapter C is connected to the lower end of the part 50 by a pin 52 extending through members 54,56 of the adapter and a transverse aperture in the part 50.

The assemblies 10,12, as previously mentioned, are connected to one another by tapered roller bearings 14,16 and the parts are selectively rotated relative to one another in opposite directions by a reversible hydraulic motor D connected to the outer side of the part 30 with its driving shaft 60 extending through and opening in the part 39 into the gear case 18, that is, the space between the parts 20,30. A pinion gear 62 detachably keyed to the end of the shaft 60 is continuously in mesh with an internal ring gear assembly 64 comprising an internal gear 66 bolted to the upper side of an annular plate-like disk 68 having a central opening through which the shaft or cylindrical part 50 projects. The gear assembly 64 includes a collar part 70 welded to its upper side, surrounding the part 50 of assembly 12 and spaced slightly therefrom. The part 70 forms a hub for the ring gear assembly 64 and together with the part 68 is keyed to the shaft or part 50 be keys 72,74 spaced 180° circumferentially about the part 50. The inner races of the bearings 14,16 which races are fixed to the part 50 are separated from one another by the hub part 70 of the ring gear assembly 64 and the outer races are fixed in collar-like or tubular members 76,78 of short axial length welded to the underside of the part 30 and the top side of the part 20, respectively.

Relative rotation between the assemblies is adapted to be stopped and/or the assemblies held in fixed angular relation to one another by a hydraulically released spring applied brake device E fixed to the outer side of the plate-like part 30 of the assembly 10 diagrammatically opposite to the motor D. The rotor shaft 80 of the brake E extends through an aperture in the part 30, within which it is supported by a ball bearing 82, into the gear case or housing 18, that is the space between the parts 20,30 and has detachably fixed thereto a pinion gear 84 in mesh with the internal ring gear 66.

Hydraulic fluid is conducted from assembly 10 to assembly 12 by a manifold device 86 detachably connected to the outer side of the part 30 and having a cylindrical section 88 projecting to the opposite side of the part 30 and into a cylindrical central bore or aperture 90 in the end of the part 50 adjacent thereto. In the depicted device the section 92 of the manifold 86 from which section the section 88 projects is cylindrical, of slightly larger diameter than the section 88 and the manifold 86 is supported on the part 30 by two diametrically located dowel pins 94 fixed to the section 92 and extending into slots in the upper side of the part 30. There is considerable clearance between the manifold 86 and the part 30 where it projects through the latter so as to permit free movement of the manifold in the event of flexing of the part 50. The manifold 86 in effect floats on the part 30 thus avoiding possible side loading of the manifold which might result in leakage of fluid thereabout. The dowel pins 94 also retains the manifold in a predetermined axial position and prevents its rotation with the part 50. A gland 98 fixed to the outside of the part 30 includes a cup type seal which does not prevent or interfere with the aforementioned floating character of the connection of the manifold 86 with the part 30 preventing leakage of gear case oil from the assembly 10 to the outside thereof through the connection of the manifold to the part 30.

Figure 3:
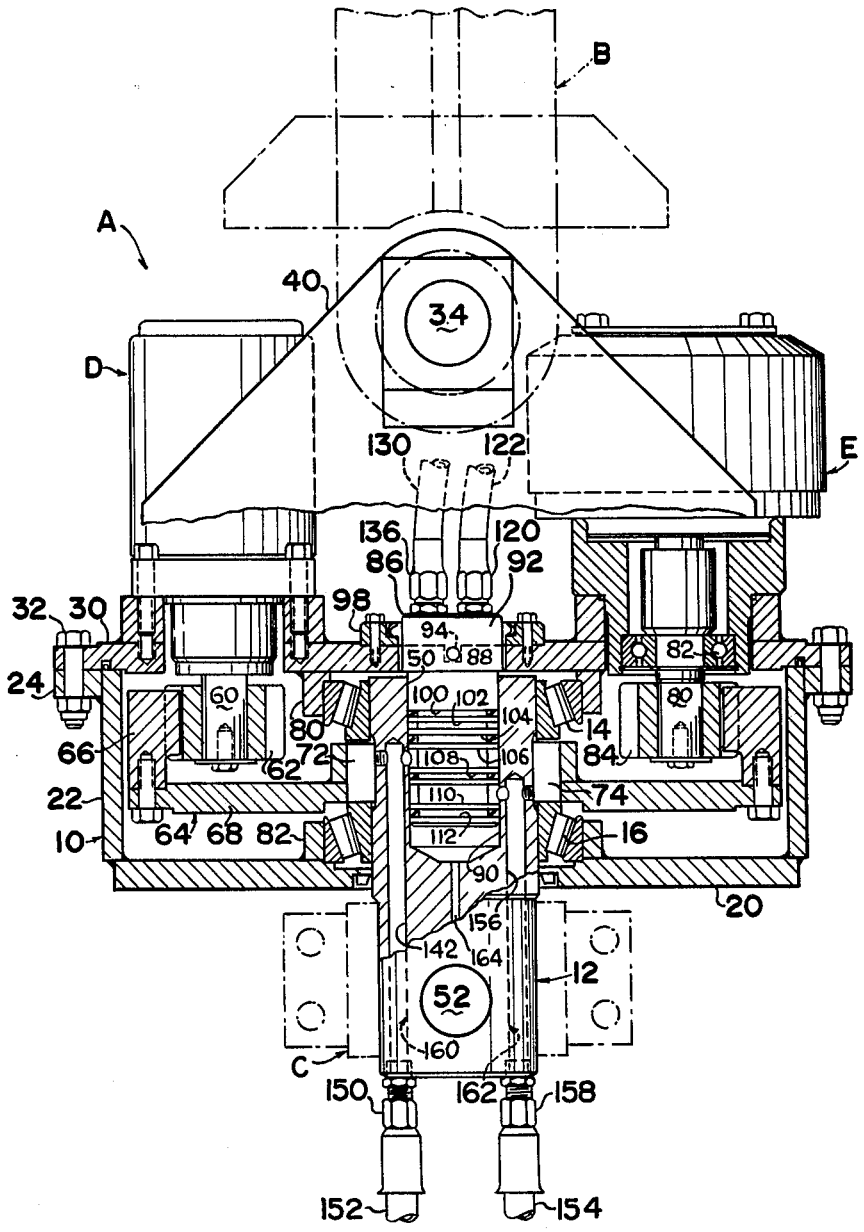
FIG. 3 is a sectional view, with parts in elevation, approximabely on the line 3—3 of FIG. 1.
Figure 4:
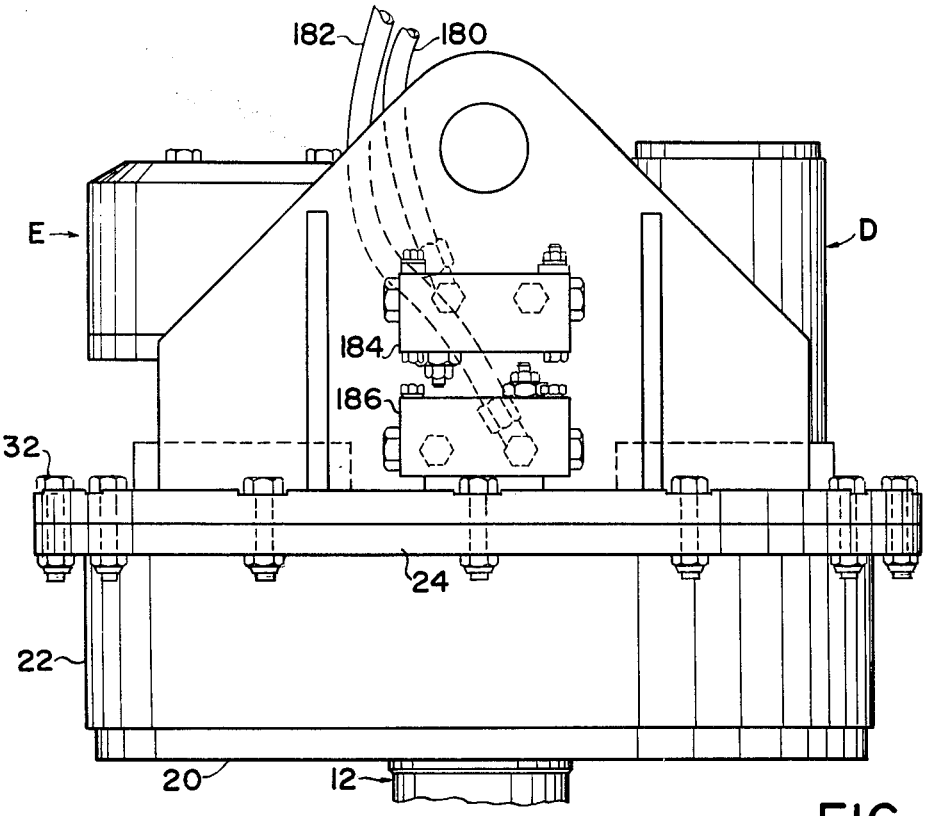
FIG. 4 is an elevational view of the coupler looking at the side opposite from the side shown in FIG. 1.
Figure 5:
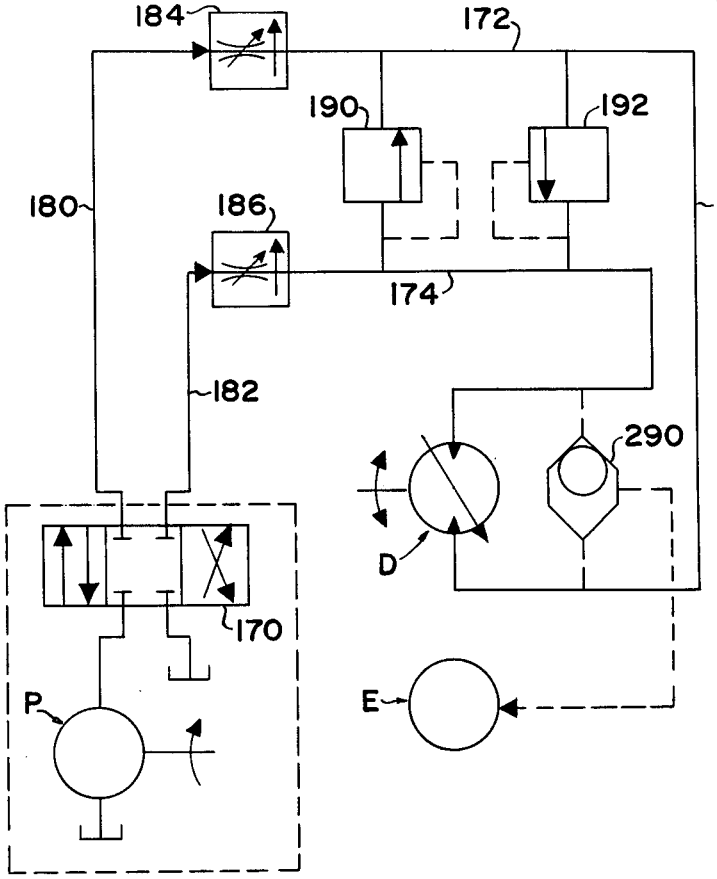
FIG. 5 is a schematic view of the hydraulic circuitry for controling rotation of the coupler.

The section 92 of the manifold part 86 is provided with a plurality of external circumferential grooves of which there are seven (7) in the depicted device designated 100, 102, 104, 106, 108, 110, 112 from top to bottom as viewed in FIG. 3. In the depicted device grooves 100, 102, 104, 108, 112 are of equal width and grooves 100, 104, 108, 112 have O-ring type seals therein. Grooves 106, 110 are of equal width and about three or four times as wide as the other grooves.

Groove 106 of the manifold part 86 is connected by a short cylindrical aperture or bore extending transversely of the length of the section 88 of the manifold part 86 to the inner end of a longitudinally or axially extending relatively short aperture or bore in the section 88 of the manifold the other end of which aperture opens into the outer end of the manifold 86 and is tapped for the reception of a fitting 120 on the end of a flexible hydraulic hose 122. The groove 110 is connected to a flexible hydraulic hose 130, in a manner similar to that in which the groove 106 is connected to the hose 122, by a transverse aperture or bore opening into the inner end of a longitudinally or axially extending relatively short aperture or bore and a fitting 136 on the end of the hose 130 threaded into the tapped outer end of the aperture.

Groove 106 of the maifold part 86 is connected by a short cylindrical aperture or bore extending transversely of the length of the part 50 to the inner end of a longitudinally or axially extending aperture or bore 142 in the member 50 the other end opens into the outer end of the part 50 and is tapped for the reception of a fitting 150 on the end of a flexible hydraulic hose 152. The groove 110 is connected to a flexible hydraulic hose 154, in a manner similar to that in which the groove 106 is connected to the hose 152, by a transverse aperture or bore opening into the inner end of a longitudinally or axially extending aperture or bore 156 and a fitting 158 on the end of the hose 154 threaded into the tapped outer end of the aperture 156. The groove 106 and the apertures in manifold part 86 form a fluid conduit in the manifold which, with the conduits is the part 50 form or constitute a conduit 160 for the transmission of fluid between the flexible conduits 120 and 152 throughout three hundred and sixty degrees (360°) of relative rotation between the assemblies 10,12. In like manner the groove 110 and the apertures in the manifold part 86 form a conduit in the manifold part 86 which with the conduit formed in the part 50 form or constitute a conduit 162 for the transmission of fluid between the flexible conduits 130, 154 also throughout three hundred and sixty degrees (360°) of relative rotation between the assemblies 10,12.

The groove 102 in the manifold section 86 is cross-drilled to a longitudinally extending aperture drilled from the lower end of the section 88 of the manifold part 86 as viewed in FIG. 3 to drain any high pressure fluid leaking about the seal in groove 104, into the lower end of the aperture or bore 90 in the part 50 and prevent its entering the interior of the gear case or housing formed by the parts 20,22, 30 of assembly 10. The bottom of the aperture 90 in the shaft or part 50 is connected to atmosphere by way of a small aperture or bore 164 extending therefrom to the bore in the part 50 through which the pin 52 extends. The location of the section 88 of the manifold 85 in the bore 90 of the part 50 between the parts 20, 30 of assembly 10 encloses the same and the manner in which the manifold 86 is connected to the part 30 of assembly 10 for limited movement relative thereto prevents side loading of the manifold seals by possible flexing of the part 50 when the coupler is in use and securely protects the seals from injury.

The section 92 of the manifold part 86 is short referring to the length of the section 88 of the manifold and extends a short distance from the outer side of the part 30 of the assembly 10. This together with the fact that the parts 12,14 of the assembly 10 are located relatively close together with the section 88 of the manifold part 86 in the space therebetween and the further fact that the shaft or part 50 of assembly 12 projects but a short distance from the outer side of the part 20 results in a relatively short coupler A. In other words, the space between the connections of the coupler A to a support device and to a grab device is relatively short. This is advantageous when the coupler is used with devices of the character previously mentioned.

The location of the motor D and the brake E at diametrically opposite sides of the axis of relative rotation between the assemblies 10,12 produces a balanced construction which is advantageous because in use the coupler is typically pivoted to an overhead movable support. The use of an internal ring gear for connecting the motor D to the shaft or part 50 of assembly 12 is also an advantage feature of the invention because it provides minimum overall size for optimum gear reduction and power transmission and contributed to the compact rugged construction of the coupler.

Two individual hydraulic systems are employed for supplying pressure fluid to the coupler, one for operating the pressure fluid actuated material handling implement suspended from the coupler and the other for producing relative rotation between the assemblies 10 and 12 of the coupler. Hydraulic fluid under pressure is produced by a pump P located in the apparatus with which the coupler A is supplied to and exhausted from the coupler for operating the implement suspended from the coupler by conduits including the hoses 122,130 from the operators position in the apparatus wich provides the overhead support for the coupler under the control of a three positional directional valve in the cab of the apparatus with which the coupler is. The material handling implement may include high pressure relief valves to limit the fluid pressure applied to the implement and a check valve to prevent release of the implement in the event of power failure.

Hydraulic fluid under pressure is supplied and exhausted from the coupler to produce relative rotation between the assemblies 10, 12 thereof in opposite directions through a three positional directional valve 170 in the cab of the apparatus with which the coupler is used and conduits designated generally 172,174 including hoses 180,182 leading to the coupler. The hoses 180,182 are connected to flow control valves 184,186 which limit the flow of fluid to the motor B. Relief valves 190,192 are employed to limit the pressure applied to the motor B. The hoses 194,196 between the flow control valves 184,186 and opposite sides of the motor B are connected to a shuttle valve 200 which in turn is connected to the brake E to release the same during operation of the motor B.

From the foregoing description of the preferred embodiment of the invention it will be apparent that the objects heretofore enumerated and others have been accomplished and that there has been provided a coupler for rotatably supporting a material handling instrumentality, such as a grab, from an overhead support, such as the boom of a crane for rotation through 360° in either direction which in addition to other advantages is compact and rugged in construction in which the hydraulic circuits are protected from damage by outside objects.

While the preferred embodiments of the invention have been shown and described in considerable detail, it is to be understood that the invention is not limited to the particular construction shown, and it is the intention to hereby cover all adaptations, modifications and uses thereof which come within the practice of those skilled in the art to which the invention pertains and the scope of the appended claims.

What is claimed is:

1. A coupler for connecting two members for rotation through three hundred and sixty degrees (360°) and having conduits therein for conducting hydraulic fluid from one to the other, said coupler comprising: a first assembly including spaced parallel plate-like parts; a second assembly having a cylindrical part extending through an aperture in one of said plate-like parts of said first assembly with one end thereof adjacent to another of said plate-like parts; tapered roller bearings located in the space between said plate-like parts of said first assembly connecting said assembly for rotation relative to one another; an internal gear located between said plate-like parts of said first assembly and keyed to said cylindrical part of said second assembly; a motor connected to said another of said plate-like member of said first assembly with its driven shaft extending into the space between said plate-like parts of said first assembly and having a pinion gear thereon in mesh with said internal gear; said first assembly having a cylindrical manifold part extending downwardly from said another of said plate-like member of said first assembly into a centrally located cylindrical aperture in the end of said cylindrical part of said second assembly adjacent to said another of said plate-like member of said first assembly; said cylindrical manifold part having a plurality of axially spaced circumferential grooves in its outer surface with hydraulic fluid seals in alternate grooves; conduits in the form of apertures in said manifold part of said first assembly each having one end adapted for the connection of a flexible conduit and the other end communicating with different of said grooves in said manifold part; and conduits in the form of apertures in said cylindrical part of said second assembly each having one end adapted for the connection of a flexible conduit and the other end communicating with different of said grooves in said manifold part of said first assembly with which said conduits in said manifold part of said first assembly communicates.

2. A coupler as claimed in claim 1 which the manifold part is connected to the first assembly for movement relative thereto.

3. A coupler for connecting members for rotation through three hundred and sixty degrees (360°) and having conduits therein for conducting hydraulic fluid from one to the other, said coupler comprising: a first assembly including spaced parallel plate-like parts; a second assembly having a cylindrical part extending upwardly through an aperture in one of said plate-like parts of said first assembly with one end thereof adjacent to another of said plate-like parts; tapered roller bearings located in the space between said plate-like parts of said first assembly connecting said assemblies for rotation relative to one another; an internal gear located between said plate-like parts of said first assembly and keyed to said cylindrical part of said second assembly; a hydraulically actuated motor connected to said another of said plate-like member of said first assembly with its driven shaft extending into the space between said plate-like parts of said first assembly and having a pinion gear thereon in mesh with said internal gear; a hydraulically released brake connected to said another of said plate-like member of said first assembly with its rotor shaft extending into the space between said plate-like parts of said first assembly and having a pinion gear thereon in mesh with said internal gear; said first assembly having a cylindrical manifold part extending downwardly from said another of said plate-like member of said first assembly into a centrally located cylindrical aperture in the end of said cylindrical part of said second assembly adjacent to said another of said plate-like member of said first assembly; said cylindrical manifold part having a plurality of axially spaced circumferential grooves in its outer surface with hydraulic fluid seals in alternate grooves; conduits in the form of apertures in said manifold part of said first assembly each having one end adapted for the connection of a flexible conduit and the other end communicating with different of said grooves in said manifold part; and conduits in the form of apertures in said cylindrical part of said second assembly each having one end adapted for the connection of a flexible conduit and the other end communicating with different of said grooves in said manifold part of said first assembly with which said conduits in said manifold part of said first assembly communicates.

4. A coupler as claimed in claim 3 in which the manifold part is connected to the first assembly for movement relative thereto.

5. A coupler for connecting two members for rotation through three hundred and sixty degrees (360°) and having conduits therein for conducting hydraulic fluid from one to the other, said coupler comprising: a first assembly adapted for connection to an overhead support and including spaced parallel plate-like parts; a second assembly adapted for connection to a hydraulically actuated material handling implement and having a cylindrical part extending upwardly through an aperture in one of said plate-like parts of said first assembly with one end thereof adjacent to another of said plate-like parts; tapered roller bearings located in the space between said plate-like parts of said first assembly rotatably connecting said second assembly to said first assembly; an internal gear located between said plate-like parts of said first assembly and keyed to said cylindrical part of said second assembly; a hydraulically actuated motor connected to said another of said plate-like member of said first assembly with its driven shaft extending into the space between said plate-like parts of said first assembly and having a pinion gear thereon in mesh with said internal gear; a hydraulically released brake connected to said another of said plate-like member of said first assembly with its rotor shaft extending into the space between said plate-like parts of said first assembly and having a pinion gear thereon in mesh with said internal gear; said first assembly having a cylindrical manifold part extending downwardly from said another of said plate-like member of said first assembly into a centrally located cylindrical aperture in the end of said cylindrical part of said second assembly adjacent to said another of said plate-like member of said first assembly; said cylindrical manifold part having a plurality of axially spaced circumferential grooves in its outer surface with hydraulic fluid seals in alternate grooves; conduits in the form of apertures in said manifold part of said first assembly each having one end adapted for the connection of a flexible conduit and the other end communicating with different of said grooves in said manifold part; and conduits in the form of apertures in said cylindrical part of said second assembly each having one end adapted for the connection of a flexible conduit and the other end communicating with different of said grooves in said manifold part of said first assembly with which said conduits in said manifold part of said first assembly communicates.

6. A coupler as claimed in claim 5 in which the manifold part is connected to the first assembly for movement relative thereto.

* * * * *